United States Patent [19]

Hacker

[11] 4,328,968

[45] May 11, 1982

[54] PROTECTIVE PAD FOR THE THUMB HOLE OF A BOWLING BALL

[76] Inventor: Chuck Hacker, P. O. Box 468, Fairfield, Ohio 45014

[21] Appl. No.: 137,273

[22] Filed: Apr. 4, 1980

Related U.S. Application Data

[63] Continuation-in-part of Ser. No. 946,544, Sep. 28, 1978, abandoned.

[51] Int. Cl.[3] ..... A63B 65/06; A63B 37/00

[52] U.S. Cl. ..... 273/63 B; 128/156

[58] Field of Search ..... 273/63 A, 63 B, 63 R; 128/156, 153

[56] References Cited

U.S. PATENT DOCUMENTS

| | | | |
|---|---|---|---|
| 2,431,203 | 11/1947 | Sebastian | 128/156 |
| 2,585,691 | 2/1952 | Scholl | 128/153 |
| 2,649,088 | 8/1953 | Sigg | 128/156 |
| 3,025,854 | 3/1962 | Scholl | 128/156 |
| 3,156,242 | 11/1964 | Crowe | 128/156 X |
| 3,927,669 | 12/1975 | Glatt | 128/156 |

*Primary Examiner*—George J. Marlo

*Attorney, Agent, or Firm*—Frost & Jacobs

[57] ABSTRACT

A protective pad to be secured within the thumb hole of a bowling ball on the side opposite from that gripped tightly by the thumb, comprising a resilient synthetic resin foam member having a right parallelepiped configuration except for one tapered edge, and a relatively friction-free synethetic resin tape having a pressure sensitive adhesive on an entire surface thereof to which a major face of the foam member is secured, the tape having dimensions greater than the foam member on not more than three sides thereof. The foam member is placed within a thumb hole with the tapered edge spaced inwardly from the entrance to the hole, and the tape is secured to the wall of the thumb hole on the sides overlying the foam member.

4 Claims, 9 Drawing Figures

PROTECTIVE PAD FOR THE THUMB HOLE OF A BOWLING BALL

CROSS REFERENCE TO RELATED APPLICATION

This application is a continuation-in-part of copending application Ser. No. 946,544, filed Sept. 28, 1978, now abandoned.

BRIEF SUMMARY OF THE INVENTION

This invention relates to a resilient pad adapted to be inserted in the thumb hole of a bowling ball on the side opposite from that gripped by the thumb of a user.

To the best of applicant's knowledge present protective pads are made of cork, plastic, and/or rubber and are secured in the thumb hole of a bowling ball at the position where it is gripped tightly by the bowler. Such pads have been for the purpose of permitting the bowler to squeeze or hold the ball more securely and thus avoid dropping it. The result of installing such grips is to increase pressure on the thumb, thus increasing the likelihood of creating blisters and/or chafing of the thumb.

It is a principal object of the present invention to provide a resilient pad for use in the thumb hole of a bowling ball which will be installed at the rear of the thumb hole, that is opposite the point where the ball is gripped tightly by the thumb, the pad providing a relatively friction-free surface which tightens the thumb hole but has sufficient resilience to allow the bowler's thumb to come out cleanly without danger of hanging.

The resilient pad of the present invention permits a bowler to relax his hand and release the ball with more accuracy and consistency, and reduces or minimizes blisters, chafing, and/or cuts on the thumb or the bowler.

According to the invention there is provided a protective pad which when secured within the thumb hole of a bowling ball on the side opposite from that gripped tightly by the thumb comprises a resilent synthetic resin foam member having a right parallelepiped configuration and positioned within the thumb hole with one edge thereof spaced inwardly from the entrance to the thumb hole, and a relatively friction-free synthetic resin tape having a pressure sensitive adhesive on one entire surface thereof to which a major face of said foam member is secured, the tape having dimensions greater than the foam member on at least two sides thereof. The synthetic resin tape is adhered to the wall of the thumb hole on at least two sides of the foam member in overlying relation thereto.

A protective pad, in accordance with one embodiment of the invention, is secured within the thumb hole of a bowling ball on the side opposite from that gripped tightly by the thumb, the pad comprising a resilient synthetic resin foam member having a right parallelepiped configuration and positioned within said thumb hole with one edge thereof spaced inwardly from the entrance to said thumb hole, a synthetic resin film adhered to one major face of said foam member and interposed between said foam member and the wall of said thumb hole, and a relatively friction-free synthetic resin tape having a pressure sensitive adhesive on one entire surface thereof to which the other major face of said foam member is secured, said tape having dimensions greater than said foam member on three sides only thereof whereby said tape is secured to said wall of said thumb hole on said three sides of said foam member in overlying relation thereto, the fourth side of said foam member being remote from said entrance to said thumb hole.

In accordance with another embodiment of the invention there is provided a protective pad which when secured within the thumb hole of a bowling ball on the side opposite from that gripped tightly by the thumb comprises a resilient synthetic resin foam member having a right parallelepiped configuration and positioned within said thumb hole with one edge thereof spaced only slightly inwardly from the entrance to said thumb hole, a pressure sensitive adhesive film on one major face of said foam member in contact with a wall of said thumb hole, and a relatively friction-free synthetic resin tape having a pressure sensitive adhesive on one entire surface thereof to which the other major face of said foam member is secured, said tape having dimensions greater than said foam member on two sides only thereof whereby said tape is adhesively secured to said wall of said thumb hole along said two sides of said foam member in overlying relation thereto.

BRIEF DESCRIPTION OF THE DRAWING

Reference is made to the accompanying drawing wherein.

DETAILED DESCRIPTION

In preferred embodiments of the invention a resilient polyurethane foam member is provided having a right parallelepiped configuration. The size of the foam member may vary, ranging, e.g., from about one inch to about 2 inches in length. The width of the foam member may range from about $\frac{3}{4}$ inch to about $1\frac{1}{4}$ inches. Regardless of variations in length and width the thickness of the foam member is maintained at about $\frac{1}{4}$ inch since this has been found to provide adequate resilience, while variations in width permit the size of the thumb hole to be adjusted to any desired extent.

In the embodiment of FIGS. 1–4, a rectangular synthetic resin film is adhered to one major face of the foam member, and is preferably of the same dimensions as this major face of the foam member. A resin film having a pressure sensitive adhesive on one surface thereof and sold under the registered trademark Scotch Tape, has been found to be entirely satisfactory.

A rectangular synthetic resin tape having a pressure sensitive adhesive on one surface thereof is secured to the other major face of the foam member. Preferably this rectangular tape is a polyvinyl resin of about 3 mils thickness. This has been found to have a relatively friction-free surface which is impermeable to moisture, chalk, dust and the like. Preferably the rectangular tape is so dimensioned as to extend outwardly about ½ inch beyond each long edge of the foam member, about 3/16 inch beyond a short edge of the foam member and in substantial alignment with the other short edge of the foam member. The pressure sensitive adhesive covers an entire face of the polyvinyl resin tape.

Preferably each corner of the polyvinyl tape is beveled in order to facilitate insertion into the thumb hole of a bowling ball.

Figure 1:
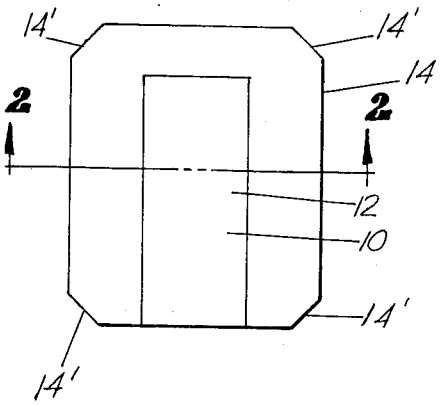
FIG. 1 is a plan view of a protective pad illustrating an embodiment of the invention.
Figure 2:
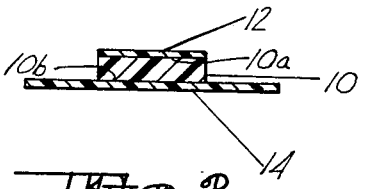
FIG. 2 is a sectional view taken along the line 2—2 of FIG. 1.

Referring to FIGS. 1 and 2 of the drawing, a protective pad in accordance with a preferred embodiment of the invention includes a resilient polyurethane foam member 10 having two rectangular major faces 10*a* and 10*b*. A synthetic resin film such as Scotch Tape is indicated at 12 and is adhered to surface 10*a* of the foam member. It has the same dimensions as the major face 10*a*.

A polyvinyl resin tape having a pressure sensitive adhesive covering an entire face thereof is indicated at 14 and is adhered to the major face 10*b* of the foam member. As shown in FIG. 1 the polyvinyl resin tape extends outwardly beyond three edges of the foam member and is substantially aligned with the fourth edge thereof. Preferably each corner of the tape 14 is cut or beveled as indicated at 14'.

When assembled in the manner illustrated in FIGS. 1 and 2, the protective pad of the invention can readily be inserted and secured in the thumb hole of a bowling ball. More specifically, the thumb hole should first be cleaned so as to be free of moisture, oil, dust and the like. The pad is folded lengthwise with the pressure sensitive adhesive covering the polyvinyl resin tape facing outwardly, and the pad is slid into the thumb hole by keeping the foam member in contact with the surface of the thumb hole. The edge of the polyvinyl tape flush with a short edge of the foam member is inserted first into the thumb hole, and the entire pad is positioned therein deep enough to allow the short edge of the tape extending about 3/16 inch beyond the edge of the foam member to be adhered to the wall of the thumb hole adjacent or just below the entrance thereto. The pad and polyvinyl tape are then smoothed out and pressure is exerted on each edge of the polyvinyl tape 14.

Figure 3:
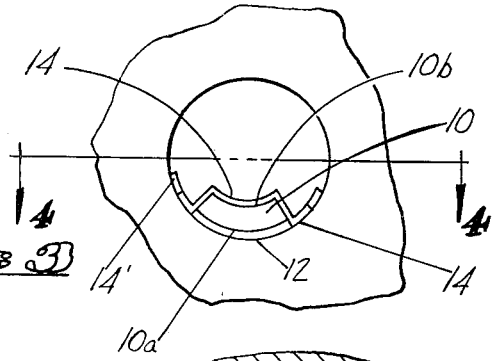
FIG. 3 is a diagrammatic plan view showing the protective pad of FIGS. 1 and 2 secured within the thumb hole of a bowling ball.
Figure 4:
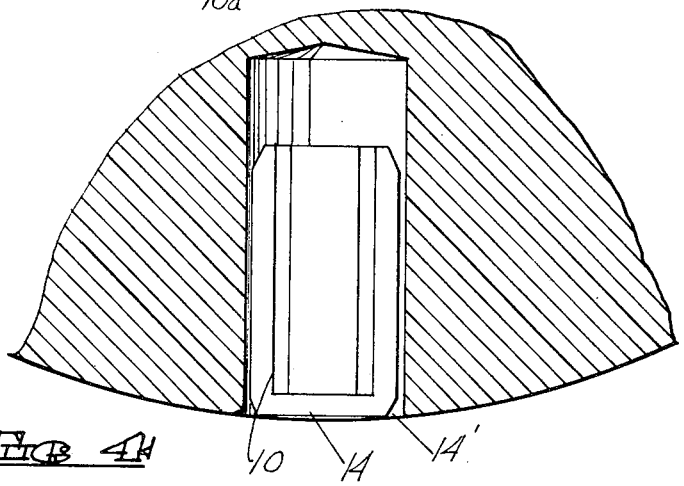
FIG. 4 is a fragmentary sectional view taken along the line 4—4 of FIG. 3.

The desired positioning of the protective pad of the invention within a thumb hole is illustrated in FIGS. 3 and 4. As will be apparent therefrom the tape 14 overlies the foam member 10, and the three margins of the tape extending beyond the edges of the foam member are adhered firmly to the wall of the thumb hole. The Scotch Tape 12 is interposed between the foam member and the wall of the thumb hole, so that the foam member is surrounded by the polyvinyl tape and Scotch Tape when positioned in the thumb hole on all but the one minor surface thereof which faces inwardly and is remote from the thumb hole entrance. Accordingly, the foam member is protected against deterioration by the polyvinyl tape and Scotch Tape.

The protective pad is positioned in that portion of the thumb hole opposite to that which will be grasped firmly by the thumb of a bowler, i.e. the rear side. It is evident that the pad provides a resilient, relatively friction-free surface which protects the thumb of the bowler against chafing and/or blisters, but at the same time "sizes" the thumb hole opening without adversely affecting release of the ball.

Any of the presently available conventional pressure sensitive adhesives, when applied to one face of the polyvinyl resin tape, provide a secure adhesive attachment to the clean surface of a thumb hole, so that the protective pad may be used repeatedly, since it is substantially impermeable to moisture, dirt, and the like after application.

It will be understood that the relative thickness of the foam member 10, resin film 12 and resin tape 14 have been exaggerated in the drawing for clarity of illustration. FIGS. 3 and 4 are somewhat diagrammatic views, and the dimensions thereof should also not be considered as representative.

While a Scotch Tape film 12 and a polyvinyl tape 14 of about 3 mil thickness have been indicated to be preferred elements of the invention, other synthetic resin materials having similar properties may be substituted. Other resilient foamed materials may also be substituted for the polyurethane foam.

Figure 5:
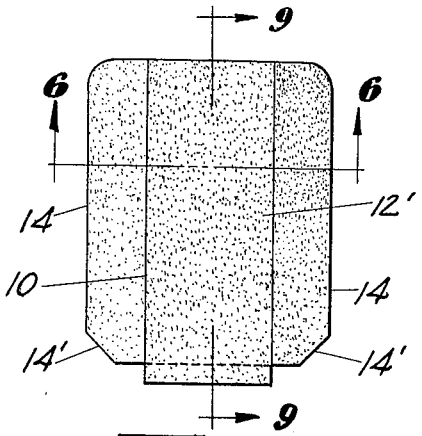
FIG. 5 is a plan view of a protective pad illustrating a further embodiment of the invention.
Figure 6:
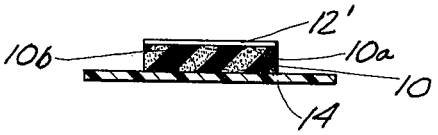
FIG. 6 is a sectional view taken along the line 6—6 of FIG. 5.
Figure 7:
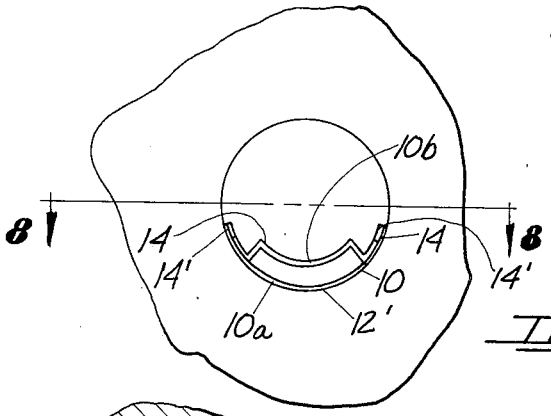
FIG. 7 is a diagrammatic view showing the protective pad of FIGS. 5 and 6 secured within the thumb hole of a bowling ball.
Figure 8:
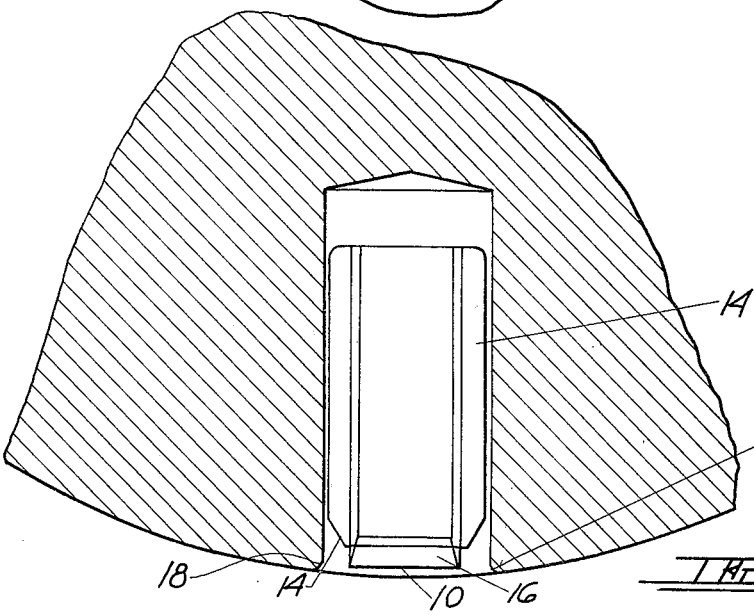
FIG. 8 is a fragmentary sectional view taken along the line 8—8 of FIG. 7.
Figure 9:
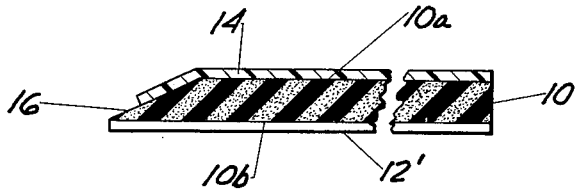
FIG. 9 is a sectional view taken along the line 9—9 of FIG. 5.

Another preferred embodiment of the invention is shown in FIGS. 5 through 8 wherein like parts have been given like index numerals. In FIGS. 5–8 a resilient polyurethane foam member 10 having two rectangular major faces 10*a* and 10*b* is coated over one major face 10*a* with a conventional pressure sensitive adhesive film 12'. A relatively friction-free polyvinyl resin tape 14 is provided having a conventional pressure sensitive adhesive covering one entire face thereof (FIG. 5). As shown in FIGS. 5 and 6 the tape 14 is adhered to the other major face 10*b* of foam member 10. The tape is so dimensioned that it extends outwardly beyond only two edges of foam member 10, e.g. about ⅜ inch on each side. Preferably at least two corners of the tape are cut or beveled as indicated at 14'.

In the embodiment of FIGS. 5–8 the length of the foam member 10 may be, e.g., 2⅛ inches and the length of the tape 14 may be 2 inches. As will be apparent from FIGS. 5 and 8, one edge of the foam member 10 projects outwardly about ⅛ inch beyond an edge of the tape 14 while the opposite edges of foam member 10 and tape 14 are in substantial alignment. In addition, a tapered or chamfered surface is preferably provided as shown at 16 in FIG. 8 on the outwardly facing major face 10*b* of foam member 10, in order to ease entry of the thumb into the thumb hole.

When the protective pad shown in FIGS. 5–8 is installed in the thumb hole of a bowling ball, it is so positioned that the tapered edge of foam member 10 is spaced only sligthly inwardly from the entrance to the thumb hole, i.e., where the bevel 18 (FIG. 8) of the thumb hole ends.

In other respects the embodiment of FIGS. 5–8 is similar to that of FIGS. 1–4 described above.

It is therefore evident that the protective pad of the invention achieves the primary objective set forth above. Although preferred embodiments have been described, the invention is not so limited, and modifications are considered to be within the spirit and scope of the invention. Accordingly, no limitations are to be inferred except as set forth in the appended claims.

I claim:

1. A protective pad adapted to be secured within the thumb hole of a bowling ball on the side opposite from that gripped tightly by the thumb comprising a resilient synthetic resin foam member having a right parallelepiped configuration except for one edge thereof adapted to be positioned only slightly inwardly from the entrance to said thumb hole, a film secured by pressure sensitive adhesive to one major face of said foam member for contacting a wall of said thumb hole, a relatively friction-free synthetic resin tape having a pressure sensitive adhesive on one entire surface thereof to which the other major face of said foam member is secured, said tape having dimensions greater than said foam member on two sides only thereof whereby said tape is adhesively secured to said wall of said thumb hole along said two sides of said foam member in overlying relation thereto, and said one edge of said foam member being gradually reduced in thickness from a position adjacent the side to which said tape is secured to provide a tapered edge to ease entry of the thumb into the thumb hole.

2. The pad claimed in claim 1, wherein said foam member is a polyurethane foam having a thickness of about one quarter inch.

3. The pad claimed in claim 1, wherein said tape is a polyvinyl resin of about 3 mils thickness and of rectangular shape so as to extend beyond said foam member about $\frac{3}{8}$ inch on each of said two sides thereof.

4. The pad claimed in claim 1, wherein said one edge of said foam member projects outwardly beyond an edge of said overlying tape.

* * * * *